US010529297B2

(12) United States Patent
Liu et al.

(10) Patent No.: US 10,529,297 B2
(45) Date of Patent: Jan. 7, 2020

(54) DISPLAY PANEL AND COMMON VOLTAGE COMPENSATION METHOD THEREOF AND DISPLAY DEVICE

(71) Applicants: BOE Technology Group Co., Ltd., Beijing (CN); Hefei Xinsheng Optoelectronics Technology Co., Ltd., Anhui (CN)

(72) Inventors: Yuanyuan Liu, Beijing (CN); Min Wang, Beijing (CN); Wenwu Lu, Beijing (CN); Ruifang Du, Beijing (CN); Rui Ma, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 15/765,535

(22) PCT Filed: Sep. 1, 2017

(86) PCT No.: PCT/CN2017/100193

§ 371 (c)(1),
(2) Date: Apr. 3, 2018

(87) PCT Pub. No.: WO2018/126721

PCT Pub. Date: Jul. 12, 2018

(65) Prior Publication Data

US 2019/0080663 A1 Mar. 14, 2019

(30) Foreign Application Priority Data

Jan. 3, 2017 (CN) ..... 2017 1 0002188

(51) Int. Cl.
*G09G 3/36* (2006.01)

(52) U.S. Cl.
CPC ..... *G09G 3/3696* (2013.01); *G09G 3/3655* (2013.01); *G09G 2310/0232* (2013.01);
(Continued)

(58) Field of Classification Search
CPC ..... G09G 3/3696; G09G 3/3655; G09G 3/20; G09G 5/18
See application file for complete search history.

(56) References Cited

U.S. PATENT DOCUMENTS 8,773,339 B2 * 7/2014 Kim ..... G09G 3/3655 345/100
9,361,850 B2 * 6/2016 Woo ..... G09G 3/3655
(Continued)

FOREIGN PATENT DOCUMENTS

CN 1680990 A 10/2005
CN 101320550 A 12/2008
(Continued)

OTHER PUBLICATIONS

International Search Report dated Dec. 1, 2017 issued in corresponding International Application No. PCT/CN2017/100193.
(Continued)

*Primary Examiner* — Sardis F Azongha
(74) *Attorney, Agent, or Firm* — Nath, Goldberg & Meyer; Joshua B. Goldberg; Daniel Bissing

(57) ABSTRACT

The present disclosure provides a display panel, a method for compensating a common voltage thereof, and a display device, belongs to the field of display technology and can solve the problem that the existing display panel cannot effectively compensate the common voltage in the middle region thereof. The display panel includes a plurality of compensation regions, each of the compensation regions is provided with a plurality of common electrodes. The display panel includes a compensation circuit corresponding to each
(Continued)

compensation region. The compensation circuit may compensate an actual common voltage of the common electrode in a corresponding compensation region, according to an average value of a difference between an actual common voltage and a preset common voltage of each common electrode in the corresponding compensation region.

15 Claims, 3 Drawing Sheets

(52) U.S. Cl.
CPC ..... *G09G 2320/0223* (2013.01); *G09G 2320/0242* (2013.01)

(56) References Cited

U.S. PATENT DOCUMENTS

| | | | | |
|---|---|---|---|---|
| 9,472,158 | B2 * | 10/2016 | Lin | G09G 3/3688 |
| 9,601,077 | B2 * | 3/2017 | Lim | G09G 3/3696 |
| 9,606,382 | B2 * | 3/2017 | Jo | G09G 3/3655 |
| 9,911,391 | B2 * | 3/2018 | Sung | G09G 3/3655 |
| 9,978,326 | B2 * | 5/2018 | Kim | G09G 3/3655 |
| 2008/0143703 | A1 * | 6/2008 | Huang | G09G 3/3611 345/211 |
| 2008/0303763 | A1 | 12/2008 | Lim | |
| 2008/0303770 | A1 * | 12/2008 | Oke | G09G 3/3655 345/92 |
| 2009/0066627 | A1 | 3/2009 | Yin | |
| 2013/0328750 | A1 * | 12/2013 | Moh | G09G 3/3655 345/58 |
| 2014/0028535 | A1 * | 1/2014 | Min | G09G 3/18 345/87 |
| 2015/0356951 | A1 | 12/2015 | Wang | |
| 2017/0162100 | A1 * | 6/2017 | Chen | G09G 3/2007 |

FOREIGN PATENT DOCUMENTS

| | | | |
|---|---|---|---|
| CN | 101383128 | A | 3/2009 |
| CN | 102013235 | A | 4/2011 |
| CN | 102842295 | A | 12/2012 |
| CN | 103137082 | A | 6/2013 |
| CN | 104050942 | A | 9/2014 |
| CN | 104269147 | A | 1/2015 |
| CN | 106782397 | A | 5/2017 |
| JP | H9-179098 | A | 7/1997 |
| KR | 10-2010-0063170 | A | 6/2010 |
| KR | 20100063170 | A | 6/2010 |

OTHER PUBLICATIONS

First Office action of CN Application No. 201710002188.7 dated Sep. 4, 2018 and English Translation.

* cited by examiner

DISPLAY PANEL AND COMMON VOLTAGE COMPENSATION METHOD THEREOF AND DISPLAY DEVICE

CROSS-REFERENCE TO RELATED APPLICATION

This is a National Phase Application filed under 35 U.S.C. 371 as a national stage of PCT/CN2017/100193, filed on Sep. 1, 2017, an application claiming priority to Chinese Patent Application No. 201710002188.7, filed on Jan. 3, 2017 in the Chinese Intellectual Property Office, the present disclosure of which is incorporated by reference herein.

TECHNICAL FIELD

The present disclosure relates to the field of display technologies, and in particular relates to a display panel, a method for compensating a common voltage thereof, and a display device.

BACKGROUND

With the increasing popularity of TFT-LCDs in people's daily lives, the quality requirements for TFT-LCD display screens are also increasing. Therefore, there is a need for higher quality design for existing products. For certain special screens, to prevent a greenish phenomenon and a line afterimage phenomenon of display from occurring is an important part of high quality design.

Specifically, the greenish phenomenon of the TFT-LCD refers to a phenomenon that under certain special screens (such as 1Dot127, 2Dot127, etc.), the human eyes observe that the screen displayed by a display panel is green, and the line afterimage phenomenon refers to a phenomenon that line residue appears at the border between black and white when the display panel is switched to a pure grayscale screen, after displaying a black and white checkerboard for a long period of time. There are many causes for the greenish phenomenon and the line afterimage phenomenon. The most important cause is that the resistance or capacitance of a data line of the display panel is so large that a common voltage $V_{COM}$ is pulled.

SUMMARY

According to an aspect of the disclosure, a display panel is provided. The display panel may include a plurality of compensation regions. Each of the plurality of compensation regions is provided with a respective common electrode. The display panel further includes a compensation circuit corresponding to each of the plurality of compensation regions. The compensation circuit may compensate an actual common voltage of the respective common electrode in a corresponding compensation region, according to an average value of a difference between the actual common voltage and a preset common voltage of the respective common electrode in the corresponding compensation region.

Optionally, he compensation circuit may include a compensation sub-circuit, an acquisition sub-circuit, and a calculation sub-circuit; the acquisition sub-circuit may obtain actual common voltages of a plurality of common electrodes in the corresponding compensation region; the calculating sub-circuit may calculate an average value of differences in common voltage of the plurality of common electrodes in the corresponding compensation region, according to the actual common voltage and the preset common voltage of each common electrode; and the compensation sub-circuit may compensate the actual common voltage of each common electrode in the corresponding compensation region, according to the average value of the differences in common voltage of the plurality of common electrodes in the corresponding compensation region.

Optionally, a plurality of pixel units are disposed in each compensation region; the acquisition sub-circuit may include a pixel voltage detection unit and a calculation unit; the pixel voltage detecting unit may detect a pixel voltage in each of the plurality of pixel units in the corresponding compensation region; and the calculation unit may calculate the actual common voltage of each of the plurality of common electrodes in the corresponding compensation region according to the pixel voltage.

Optionally, the calculating sub-circuit may include a capacitor, a first resistor, and an amplifier; a first terminal of the amplifier is connected to a preset common voltage terminal, a second terminal of the amplifier is connected to the first resistor, and an output terminal of the amplifier is connected to a compensation common voltage terminal; and a first terminal of the capacitor is connected to an actual common voltage terminal, and a second terminal of the capacitor is connected to the first resistor.

Optionally, the compensation sub-circuit may include a plurality of compensation resistors; and the plurality of compensation resistors are connected in parallel with each other, and each of the plurality of compensation resistors is connected to the second terminal and the output terminal of the amplifier, respectively.

Optionally, the compensation sub-circuit further may include a plurality of compensation switches, each of the compensation switches is connected in series with a respective one of the plurality of compensation resistors, and the plurality of compensation switches are configured to be either turned on or turned off according to a compensation multiple corresponding to one of the plurality of compensation resistors.

Optionally, the plurality of compensation regions are arranged in a matrix.

According to an aspect of the disclosure, a method for compensating a common voltage of a display panel is provided. The display panel may include a plurality of compensation regions, and each of the plurality of compensation regions is provided with a respective common electrode; and for each of the plurality of compensation regions, the method may include a step of: compensating an actual common voltage of the respective common electrode in the compensation region, according to an average value of a difference between an actual common voltage and a preset common voltage of the respective common electrode in the compensation region.

Optionally, the step of compensating an actual common voltage of the respective common electrode in the compensation region, according to an average value of a difference between the actual common voltage and a preset common voltage of the respective common electrode in the compensation region, may include steps of: obtaining actual common voltages of a plurality of common electrodes in the compensation region; calculating an average value of differences in common voltage of the plurality of common electrodes in the compensation region, according to the actual common voltage and the preset common voltage of each common electrode; and compensating the actual common voltage of each common electrode in the compensation region, according to the average value of the differences in common voltage of the plurality of common electrodes in the compensation region.

Optionally, the step of obtaining actual common voltages of a plurality of common electrodes in the compensation region, may include steps of: detecting a pixel voltage in each of a plurality of pixel units in the compensation region; and calculating the actual common voltage of each of the plurality of common electrodes in the compensation region according to the pixel voltage.

Optionally, the compensation sub-circuit may include a plurality of compensation resistors; and the step of compensating the actual common voltage of each common electrode in the compensation region, according to the average value of the differences in common voltage of the plurality of common electrodes in the compensation region, may include: compensating the actual common voltage of each of the common electrodes in the compensation region by selecting one of a plurality of compensation resistors that corresponds to one of compensation multiples which are stored in advance, according to the average value of the differences in common voltage of the plurality of common electrodes in the compensation region and the compensation multiples.

According to an aspect of the disclosure, a display device is provided. The display device may include the display panel described above.

DETAILED DESCRIPTION

To enable those skilled in the art to better understand the technical solutions of the present disclosure, the present disclosure will be further described in detail below in conjunction with the accompanying drawings and specific implementations.

Figure 1:
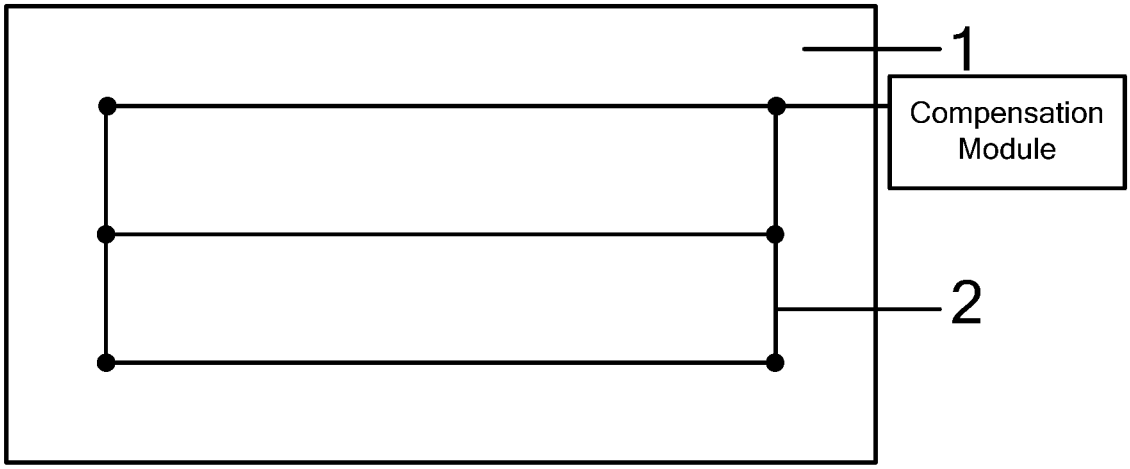
FIG. 1 is a schematic structural diagram of a display panel for compensating a common voltage.

In order to solve the above problem, an existing method for improving the greenish phenomenon and the line afterimage phenomenon is to reduce a pulled amplitude of the $V_{COM}$ by compensating the common voltage $V_{COM}$. Specifically, referring to FIG. 1, first, the pulled amplitude (the pulled amplitude is a difference between an actual common voltage and a theoretical preset common voltages of each common electrode 3) of the common voltage $V_{COM}$ is obtained by detecting a data voltage of a peripheral data line 2 of a display panel 1; and then, one or more feedback points (indicated by "●" in FIG. 1) are selected in the display panel 1 as inputs, and a compensation sub-circuit inputs a reverse compensation voltage to the feedback points so as to compensate the common voltage $V_{COM}$, whereby improving the greenish phenomenon and the line afterimage phenomenon.

In practical applications, the pulled amplitude of the common voltage $V_{COM}$ in the middle region of the display panel 1 is typically larger than the pulled amplitude of the common voltage $V_{COM}$ in the periphery region. However, the wiring is usually set only on the outer edge of the display panel 1 in order to input the reverse compensation voltage, so that the common voltage $V_{COM}$ in the middle region of the display panel 1 is not compensated, and the greenish phenomenon and the line afterimage phenomenon cannot be effectively improved.

First Embodiment

Figure 2:
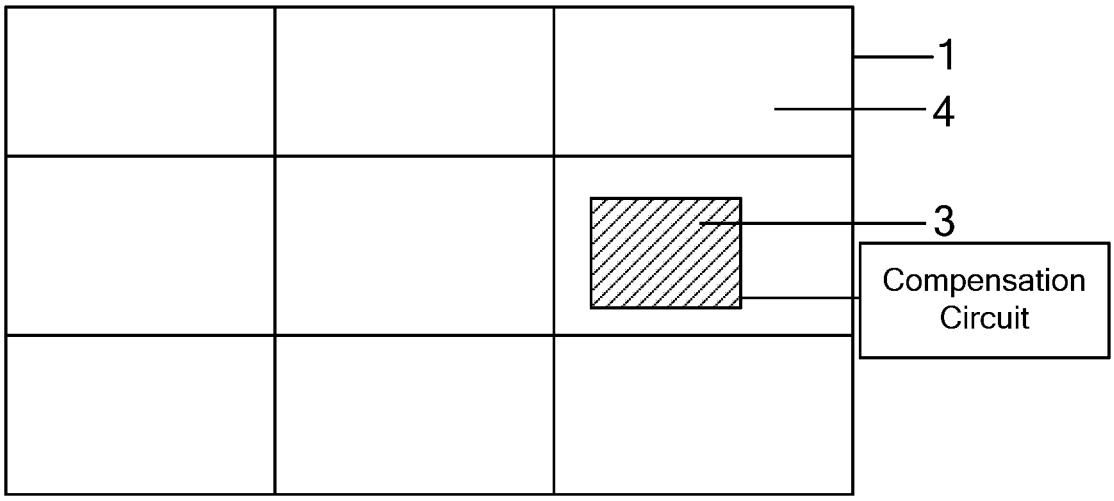
FIG. 2 is a schematic structural diagram of a display panel according to a first embodiment of the present disclosure.
Figure 3:
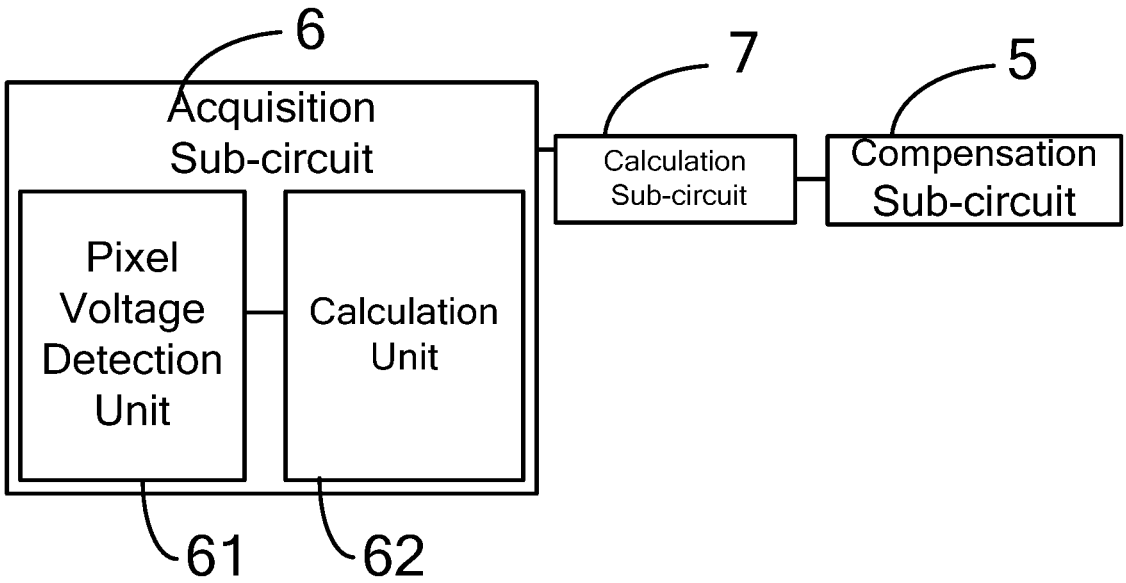
FIG. 3 is a schematic structural diagram of a compensation circuit corresponding to a compensation region of FIG. 2.
Figure 4:
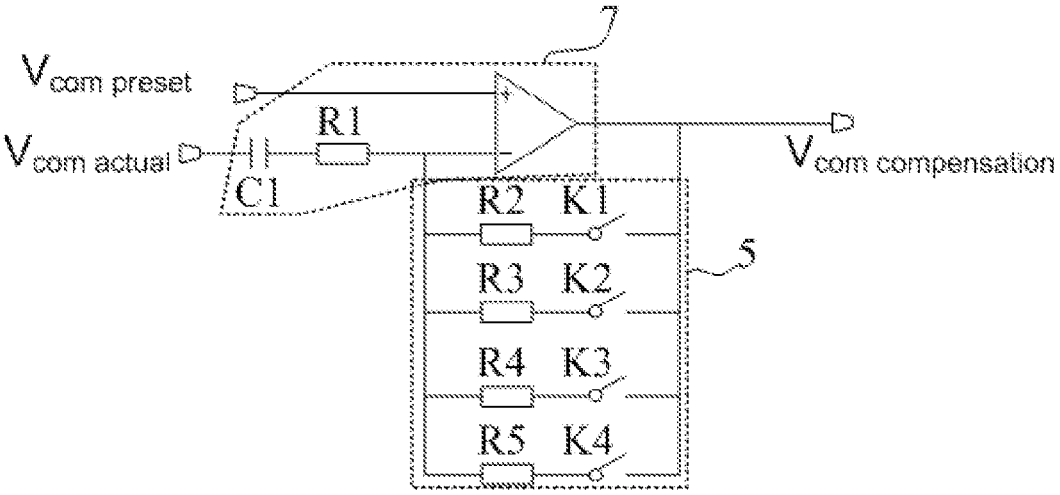
FIG. 4 is a schematic structural diagram of a compensation sub-circuit and a calculation sub-circuit of the compensation circuit of FIG. 3.

Referring to FIGS. 2 to 4, an embodiment of the present disclosure provides a display panel 1 including a plurality of compensation regions 4. Each compensation region 4 has a corresponding common electrode 3 provided therein. The common electrode 3 may be one or more common electrodes. Here, a plurality of common electrodes 3 may be in a divided form of physical structure or in a regional division form according to a positional relationship. The display panel 1 includes compensation circuits, each of which is provided corresponding to a respective one of the compensation regions 4. The compensation circuit compensates an actual common voltage of each common electrode 3 in each compensation region 4, according to an average value of differences between the actual common voltages and preset common voltages of the common electrodes 3 in each compensation region 4. It should be noted that in a case of one common electrode 3 within one compensation region 4, the compensation circuit compensates an actual common voltage of the common electrode 3 in the compensation region 4, according to a difference between the actual common voltage and preset common voltage of the common electrode 3 in the compensation region 4.

Referring to FIG. 2, only a structure of one compensation region 4 is shown in FIG. 2, and the structures of the compensation regions 4 are similar. It can be understood that a corresponding common electrode 3 is disposed in the display panel 1. When the display panel 1 includes a plurality of compensation regions 4, corresponding common electrodes 3 exist in each compensation region 4, and each compensation region 4 is provided with a corresponding compensation circuit. For the common electrodes 3 in each compensation region 4, there is a difference (that is, a pulled amplitude) between the actual common voltage and the preset common voltage of each common electrode 3 during the display process. The compensation circuit may compensate the actual common voltage of each common electrode 3 in each compensation region 4, according to the average value of the differences between the actual common voltages and the preset common voltages of the common electrodes 3 in each compensation region 4, to reduce the pulled amplitude thereof and improve the greenish phenomenon and the line afterimage phenomenon.

As shown in FIG. 2, in the present embodiment, the display panel 1 is divided into nine compensation regions 4. However, the number of the compensation regions 4 is not limited thereto, and the number of the compensation regions 4 may be set according to the size of the display panel 1, which will not be described in detail herein. For example, the compensation regions 4 are arranged in a matrix to make the compensation more uniform.

Referring to FIG. 3, the compensation circuit includes a compensation sub-circuit 5, an acquisition sub-circuit 6 and a calculation sub-circuit 7. The acquisition sub-circuit 6 may obtain the actual common voltage of each of the corresponding common electrodes 3 in each compensation region 4. The calculation sub-circuit 7 may calculate the average value of the differences in common voltage of the corresponding common electrodes 3 in the compensation region 4, according to the actual common voltage and the preset common voltage of each common electrode 3. The compensation sub-circuit 5 may compensate the actual common voltage of each common electrode 3 in each compensation region 4, according to the average value of the differences in common voltage of the corresponding common electrodes 3 in each compensation region 4.

Specifically, first, the acquisition sub-circuit 6 acquires the actual common voltage of the corresponding common electrode 3 in each of the compensation regions 4. Then, in the case that the preset common voltage of each common electrode 3 is known, the calculation sub-circuit 7 calculates the difference between the actual common voltage and the preset common voltage of each common electrode 3. The differences of all the common electrodes 3 in the compensation region 4 is added to obtain a sum, and then the sum is divided by the number of the common electrodes 3 in the compensation region 4 to obtain the average value of the differences in common voltage of the corresponding common electrodes 3 in the compensation region 4. Finally, the compensation sub-circuit 5 may compensate the actual common voltage of each common electrode 3 in each compensation region 4, according to the average value in each compensation region 4.

It should be noted that since the actual common voltage of each common electrode 3 is compensated according to the average value of the differences in common voltage of the corresponding common electrodes 3 in the compensation region 4, not every compensated actual common voltages of the common electrodes 3 are equal to the corresponding theoretical preset common voltages. The display panel of this embodiment may only reduce the pulled amplitude of each common electrode 3 in each compensation region 4 to effectively improve the greenish phenomenon and the line afterimage phenomenon, and improve the display effect.

A plurality of pixel units may be disposed in each compensation region 4, and the acquisition sub-circuit 6 may include a pixel voltage detection unit 61 and a calculation unit 62. The pixel voltage detection unit 61 may detect a pixel voltage of each pixel unit in the corresponding compensation region 4. The calculation unit 62 may calculate the actual common voltage of each common electrode 3 in the compensation region 4 based on the pixel voltage.

That is, in the present embodiment, the actual common voltage of the common electrode 3 is obtained according to the pixel voltage of each pixel unit in the compensation region 4. The reason is that the pixel voltage is measurable, but there is no good method for measuring the common voltage at present. Moreover, the actual common voltage of the common electrode 3 obtained through the pixel voltage has a higher accuracy and a smaller error.

The calculation sub-circuit 7 includes a capacitor C1, a first resistor R1 and an amplifier. A first terminal of the amplifier is connected to a preset common voltage terminal. A second terminal of the amplifier is connected to the first resistor R1. An output of the amplifier is connected to a compensation common voltage terminal. A first terminal of the capacitor C1 is connected to the actual common voltage terminal, and a second terminal of the capacitor C1 is connected to the first resistor R1.

Referring to FIG. 4, the first terminal (i.e., the positive electrode) of the amplifier is connected to the preset common voltage terminal (i.e., $V_{com\ preset}$), and the second terminal (i.e., the negative electrode) of the amplifier is connected to the first resistor R1. The output of the amplifier is connected to a compensation common voltage terminal (i.e., $V_{com\ compensation}$). The first terminal of the capacitor C1 is connected to the actual common voltage terminal (i.e., $V_{com\ actual}$), and the second terminal of the capacitor C1 is connected to the first resistor R1.

The compensation sub-circuit 5 includes a plurality of compensation resistors R2 to R5. The plurality of compensation resistors R2 to R5 are connected in parallel with each other, and each compensation resistor is connected to the output terminal and the second terminal of the amplifier, respectively.

Referring to FIG. 4, the compensation sub-circuit 5 includes the plurality of compensation resistors R2 to R5 connected in parallel with each other. Each compensation resistor is connected to the second terminal and the output terminal of the amplifier. That is, each compensation resistor is also connected in parallel with the amplifier.

The compensation sub-circuit 5 further includes a plurality of compensation switches K1 to K4, each compensation switch is connected in series with one compensation resistor, and the compensation switches K1 to K4 may be turned on or turned off according to a compensation multiple corresponding to one of the compensation resistors R2 to R5.

Referring to FIG. 4, each compensation resistor is connected in series with one compensation switch. For example, the compensation resistor R2 is connected in series with the compensation switch K1, the compensation resistor R3 is connected in series with the compensation switch K2, the compensation resistor R4 is connected in series with the compensation switch K3, and the compensation resistor R5 is connected in series with the compensation switch K4, that is, each compensation resistor has one compensation switch for controlling current to flow through the compensation resistor or not. When the compensation switch is on, a current flows through the compensation resistor connected in series with the compensation switch; when the compensation switch is off, no current flows through the compensation resistor connected in series with the compensation switch.

In this embodiment, each compensation resistor corresponds to one compensation multiple. The compensation resistor corresponding to the compensation multiple is selected (i.e., a compensation switch connected in series with the compensation resistor is turned on) according to the average value of the differences in common voltage of the corresponding common electrodes 3 in the compensation region 4, to output a corresponding compensation common voltage, so that the actual common voltage of each corresponding common electrode 3 is compensated.

Specifically, after the average value of the differences in common voltage of the corresponding common electrodes 3 of a certain compensation region 4 is calculated, a timing controller controls the second terminal of the amplifier and the compensation switches according to a compensation multiple table stored in advance. For example, the compensation multiple table may be set as follows: when the pulled amplitude of the average value of the differences in common voltage is 0 to 50 mV, the compensation multiple is 5; when the pulled amplitude of the average value of the differences in common voltage is 50 mV to 100 mV, the compensation multiple is 10, and so on, but the compensation multiples are not limited thereto. The compensation multiple table may be set based on the actual conditions of the display panel, and detailed description thereof is omitted herein. It can be understood that, according to the actual conditions of each compensation region 4, the compensation multiple of each compensation region 4 may be different, that is, the output compensation common voltage is different.

For example, in the present embodiment, R1=5KΩ, R2=10KΩ, R3=15KΩ, R4=20KΩ, and R5=25KΩ (assuming that the display panel reaches a saturation state when the display panel is compensated by 25 times), wherein the compensation switches K1 to K4 are controlled by the timing controller. When the average value (of the difference ΔV between the actual common voltage and the preset common voltage) of each region is 0 to 50 mV, the timing controller controls K1 to be turned on and K2 to K4 to be in an OFF state. At this time, the amplifier outputs a compensation multiple of 5. The compensation common voltage is input into the compensation region 4 through a common electrode line in periphery of the compensation region 4, so as to achieve the purpose of compensating the common electrode 3 in the compensation region 4, and reduce the pulled amplitude of common voltage of each pixel unit in the compensation region 4. When the average value of the difference ΔV in the compensation region 4 is between 50 mV to 100 mV, the timing controller controls K2 to be turned on, and other switches to be in an OFF state, the amplifier outputs the compensation multiple of 10. Similarly, the compensation switches K3 and K4 may be controlled by the timing controller, and detailed description thereof is omitted herein.

It should be noted that monitoring the pulled amplitude of each of the common electrodes 3 inside the display panel by the timing controller begins from a first frame of display screen, but compensating each of the common electrodes 3 of the display panel begins from a second frame of display screen. Monitoring the pulled amplitude of each of the common electrodes 3 of the display panel in real time by the timing controller can improve the problem of deterioration of display effect due to long-term use of the display panel.

In the display panel of the present embodiment, by performing region division on the display panel, real-time monitoring the pulled amplitude of the common voltage $V_{COM}$ of each common electrode in each compensation region, and compensating the common voltage $V_{COM}$ of each common electrode in each compensation region, the pulled amplitude of the common voltage $V_{COM}$ of each common electrode in each compensation region can be reduced, so that the middle region of the display panel can also be compensated, thereby effectively improving the greenish phenomenon and the line afterimage phenomenon during the display process of the display panel.

Second Embodiment

Figure 5:
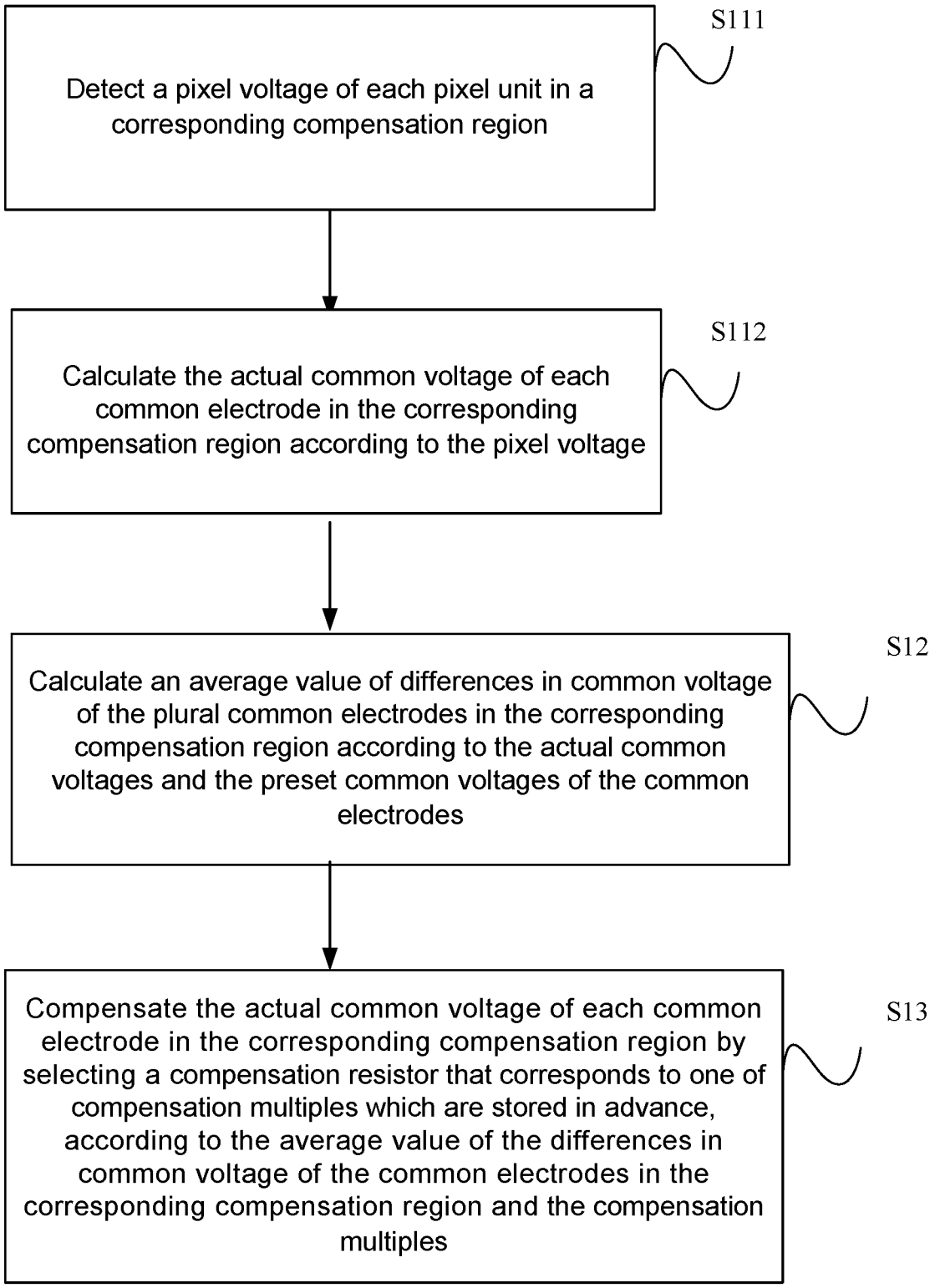
FIG. 5 is a flowchart of a method for compensating a common voltage of a display panel according to a second embodiment of the present disclosure.

Referring FIG. 5, an embodiment of the present disclosure provides a method for compensating a common voltage of a display panel. The display panel includes a plurality of compensation regions. Each compensation region is provided with respective common electrodes. For each compensation region, the compensation method includes the following step S1.

In step S1, an actual common voltage of each common electrode in each compensation region is compensated, according to an average value of differences between the actual common voltages and preset common voltages of the common electrodes in each compensation region.

Specifically, the step S1 includes a step 11, a step 12 and a step 13.

In step S11, the actual common voltage of each of the common electrodes corresponding to each compensation region is obtained.

Specifically, the step 11 may include a step 111 and a step S112.

In step S111, a pixel voltage of each of a plurality of pixel units in the compensation region is detected.

In step S112, the actual common voltage of each of the common electrodes in the compensation region is calculated based on the pixel voltage.

In step S12, an average value of differences in common voltage of the corresponding common electrodes in each compensation region is calculated according to the actual common voltage and the preset common voltage of each common electrode.

That is, the average of the differences in common voltage=Σ(the actual common voltage−the preset common voltage)/a number of the common electrodes.

In step S13, the actual common voltage of each common electrode in each compensation region is compensated according to the average value of the differences in common voltage of the common electrodes in each compensation region.

Further, the compensation sub-circuit includes a plurality of compensation resistors.

Specifically, the step S13 may include: compensating the actual common voltage of each common electrode in each compensation region by selecting one of the plurality of compensation resistors that corresponds to one of compensation multiples which are stored in advance, according to the average value of the differences in common voltage of a plurality of common electrodes in each compensation region and the compensation multiples.

The method for compensating the common voltage of the display panel may be applied to compensating the common voltage of the display panel of the first embodiment. For detailed description, reference may be made to the display panel of the first embodiment, and details will not be described herein again.

With reference to the structural diagrams of the compensation circuit shown in FIGS. 3 and 4, specifically, the method for compensating the common voltage of the display panel in this embodiment may be as follows.

First, the pixel voltage in each pixel unit in a compensation region is detected, and the actual common voltage of each common electrode in the compensation region is calculated according to the pixel voltage, output to the actual common voltage terminal ($V_{com\ actual}$), and input to the negative electrode of the amplifier finally.

And then, the preset common voltage of each common electrode is input to the positive electrode of the amplifier via the preset common voltage terminal ($V_{com\ preset}$). The amplifier calculates the difference in common voltage of each common electrode, and calculates the average value of the differences in common voltage of the corresponding common electrodes in the compensation region according to the difference in common voltage of each common electrode.

Finally, the actual common voltage of each common electrode in each compensation region is compensated by the following steps: by selecting one of the plurality of compensation resistors that corresponds to one of compensation multiples which are stored in advance, according to the average value of the differences in common voltage of the plurality of common electrodes in each compensation region and the compensation multiples, so as to generate the compensation common voltage; and by inputting the compensation common voltage to each common electrode in the compensation region via the compensation common voltage terminal ($V_{com\ compensation}$). For example, a compensation multiple table may be set as follows: when the pulled amplitude of an average value of differences in common voltage is 0 to 50 mV, the compensation multiple is 5. When the pulled amplitude of the average value of differences in common voltage is 50 mV to 100 mV, the compensation multiple is 10, and so on. When the average value of the differences between the actual common voltages and the corresponding preset common voltages in the compensation region is between 0 and 50 mV, the timing controller controls K1 to be turned on, and controls K2 to K4 to be turned off. In this case, the output compensation multiple of the amplifier is 5.

In the method for compensating the common voltage of the display panel according to the present embodiment, by performing region division on the display panel, real-time monitoring the pulled amplitude of the common voltage $V_{COM}$ of each common electrode in each compensation region, and compensating the common voltage $V_{COM}$ of each common electrode in each compensation region, the pulled amplitude of the common voltage $V_{COM}$ of each common electrode in each compensation region can be reduced, so that the middle region of the display panel can also be compensated, thereby effectively improving the greenish phenomenon and the line afterimage phenomenon during the display process of the display panel.

Third Embodiment

According to an embodiment, a display device including the display panel of the first embodiment is provided. The display device may be any product or component having a display function, such as a liquid crystal display panel, an electronic paper, a mobile phone, a tablet computer, a television, a display, a notebook computer, a digital photo frame, a navigator, and the like.

In the display device of the present embodiment, by performing region division on the display panel, real-time monitoring the pulled amplitude of the common voltage $V_{COM}$ of each common electrode in each compensation region, and compensating the common voltage $V_{COM}$ of each common electrode in each compensation region, the pulled amplitude of the common voltage $V_{COM}$ of each common electrode in each compensation region can be reduced, so that the middle region of the display panel can also be compensated, thereby effectively improving the greenish phenomenon and the line afterimage phenomenon during the display process of the display panel.

It should be understood that the above implementations are merely exemplary embodiments for the purpose of illustrating the principles of the present disclosure, however, the present disclosure is not limited thereto. It will be apparent to those skilled in the art that various changes and modifications can be made without departing from the spirit and essence of the present disclosure, which are also to be regarded as falling into the scope of the present disclosure.

What is claimed is:

1. A display panel comprising a plurality of compensation regions, each of the plurality of compensation regions being provided with at least one common electrode, wherein the display panel further comprises a compensation circuit corresponding to each of the plurality of compensation regions; and the compensation circuit is configured to compensate an actual common voltage of the at least one common electrode in a corresponding compensation region, according to an average value of a difference between the actual common voltage and a preset common voltage of the at least one common electrode in the corresponding compensation region, wherein the compensation circuit comprises a compensation sub-circuit an acquisition sub-circuit and a calculation sub-circuit, the acquisition sub-circuit is configured to obtain actual common voltages of a plurality of common electrodes in the corresponding compensation region;

the calculating sub-circuit is configured to calculate the average value of differences between the actual common voltages of the plurality of common electrodes in the corresponding compensation region and the preset common voltage; and the compensation sub-circuit is configured to compensate the actual common voltage of each of the plurality of common electrodes in the corresponding compensation region, according to the average value of the differences between the actual common voltages of the plurality of common electrodes in the corresponding compensation region and the preset common voltage.

2. The display panel according to claim 1, wherein a plurality of pixel units are disposed in each compensation region; the acquisition sub-circuit comprises a pixel voltage detection unit and a calculation unit;

the pixel voltage detecting unit is configured to detect a pixel voltage in each of the plurality of pixel units in the corresponding compensation region; and the calculation unit is configured to calculate the actual common voltage of each of the plurality of common electrodes in the corresponding compensation region according to the pixel voltage.

3. A display device comprising a display panel, which is the display panel of claim 2.

4. The display panel according to claim 1, wherein the calculating sub-circuit comprises a capacitor, a first resistor, and an amplifier;

a first terminal of the amplifier is connected to a preset common voltage terminal, a second terminal of the amplifier is connected to the first resistor, and an output terminal of the amplifier is connected to a compensation common voltage terminal; and a first terminal of the capacitor is connected to an actual common voltage terminal, and a second terminal of the capacitor is connected to the first resistor.

5. The display panel according to claim 4, wherein the compensation sub-circuit comprises a plurality of compensation resistors; and the plurality of compensation resistors are connected in parallel with each other, and each of the plurality of compensation resistors is connected to the second terminal and the output terminal of the amplifier, respectively.

6. The display panel according to claim 5, wherein the compensation sub-circuit further comprises a plurality of compensation switches, each of the compensation switches is connected in series with a respective one of the plurality of compensation resistors, and the plurality of compensation switches are configured to be either turned on or turned off according to a compensation multiple corresponding to one of the plurality of compensation resistors.

7. A display device comprising a display panel, which is the display panel of claim 6.

8. A display device comprising a display panel, which is the display panel of claim 4.

9. A display device comprising a display panel, which is the display panel of claim 5.

10. The display panel according to claim 1, wherein the plurality of compensation regions are arranged in a matrix.

11. A display device comprising a display panel, which is the display panel of claim 10.

12. A display device comprising a display panel, which is the display panel of claim 1.

13. A method for compensating a common voltage of a display panel, wherein the display panel comprises a plurality of compensation regions, and each of the plurality of compensation regions is provided with at least one common electrode; and for each of the plurality of compensation regions, the method comprises a step of:

compensating an actual common voltage of the at least one common electrode in the compensation region, according to an average value of a difference between an actual common voltage and a preset common voltage of the at least one common electrode in the compensation region, wherein the step of compensation an actual common voltage of the at least one common electrode in the compensation region, according to an average value of a difference between the actual common voltage and a preset common voltage of the at least one common electrode in the compensation region, comprises steps of:

obtaining actual common voltages of a plurality of common electrodes in the compensation region, calculating the average value of differences between the actual common voltages of the plurality of common electrodes in the compensation region and the preset common voltage; and compensating the actual common voltage of each of the plurality of common electrodes in the compensation region, according to the average value of differences between the actual common voltages of the plurality of common electrodes in the compensation region and the preset common voltage.

14. The method according to claim 13, wherein the step of obtaining actual common voltages of a plurality of common electrodes in the compensation region, comprises steps of:

detecting a pixel voltage in each of a plurality of pixel units in the compensation region; and calculating the actual common voltage of each of the plurality of common electrodes in the compensation region according to the pixel voltage.

15. The method according to claim 13, wherein the step of compensating the actual common voltage of each common electrode in the compensation region, according to the average value of the differences in common voltage of the plurality of common electrodes in the compensation region, comprises:

compensating the actual common voltage of each of the common electrodes in the compensation region by selecting one of a plurality of compensation resistors that corresponds to one of compensation multiples which are stored in advance, according to the average value of the differences in common voltage of the plurality of common electrodes in the compensation region and the compensation multiples.

* * * * *